United States Patent [19]

Richmon

[11] Patent Number: 4,895,373

[45] Date of Patent: Jan. 23, 1990

[54] TRAINING DEVICE FOR GOLFERS

[76] Inventor: Sidney Richmon, 5800 W. Club La., Richmond, Va. 23226

[21] Appl. No.: 283,714

[22] Filed: Dec. 13, 1988

[51] Int. Cl.[4] ..... A63B 69/36

[52] U.S. Cl. ..... 273/183 B; 273/189 R

[58] Field of Search ..... 273/189 R, 189 A, 188 R, 273/183 B, 190 R

[56] References Cited

U.S. PATENT DOCUMENTS

| | | | |
|---|---|---|---|
| 2,093,153 | 9/1937 | McCarthy | 273/189 R |
| 2,808,267 | 10/1957 | Heaton | 273/189 R |
| 3,679,214 | 7/1972 | Boyte | 273/189 R |
| 3,740,052 | 6/1973 | Arkin | 273/189 R |
| 4,058,852 | 11/1977 | Aragona | 273/189 R |
| 4,359,221 | 11/1982 | Taylor | 273/189 R |

*Primary Examiner*—George J. Marlo

*Attorney, Agent, or Firm*—Alan E.J. Branigan

[57] ABSTRACT

A training device for golfers comprising a belt of gum-rubber or similar elastic material forms an adjustable loop about one arm over the respective shoulder, is wound under tension substantially diagonally across the back down to and around the lower waist in the hip region for at least one full turn and is retained about the upper buttocks area of the hip region by being adjustably fastened to itself. The device promotes proper coordination between body and limb parts during a swing and builds muscle-memory of correct movements and sequence thereof without being unduly constrictive in a golfer's activities.

13 Claims, 3 Drawing Sheets

TRAINING DEVICE FOR GOLFERS

This invention relates to training devices for golfers and, in particular, to a hip, shoulder, and arm guiding device that is worn upon the body during practice to effect muscle-memory training in proper motions and sequence thereof to achieve learning of more perfectly executed golf strokes.

While professional golfers' opinions vary with respect to details of instruction and training, it is well established that correct coordination of hip, shoulder, and arm motion is essential for a properly executed golf stroke.

For instance, U.S. Pat. No. 2,093,152 to McCarthy discloses a harness-like strap arrangement which restrains particularly the motion of the right arm to prevent a badly executed storke and to guide the golfer into learning proper movement of the right arm during a golf stroke. In another example, U.S. Pat. No. 3,740,052 to Arkin shows a golf practice device that uses an elastic cord attached to the forearm and to the opposite arm's shoulder to teach the player proper coordination. Body-worn training and practice aids are also known in other sports. For examples, Ferrara (U.S. Pat. No. 3,101,196) and Taylor (U.S. Pat. No. 4,359,221) disclose harness and strap like devices for guiding bowlers in proper body posture and motions during delivery of the ball.

It is an object of the present invention to provide an extraordinarily simple, yet highly effective device for use by golfers in practice and training to promote correct coordination body and limb parts during a golf stroke or swing and to build muscle-memory of proper movements and sequence thereof without being unduly constrictive in a golfer's activities.

SUMMARY OF THE INVENTION

In accordance with principles of the present invention, a training aid for golfers is provided in the form of a belt-like body-engaging member that is worn on the body and that engages an arm in its shoulder region along and approximately diagonally across the back with the hip region. In particular, a loop of the belt is formed over a shoulder and is closed and secured in the back of the upper arm, and therefrom the free length of the belt is tightly wound diagonally across the golfer's back downwardly and further around the body below the waist and preferably crossing the upper buttocks area in the hip region. The belt is adjustably and releasably secured to itself in the hip region.

In one use during golf practice, the device of the present invention promotes proper sequential coordination of the shoulder motion with the leading hip motion by the action of the belt that elastically draws the looped shoulder (and therewith the upper arm) to follow the hips. In another use during golf practise, the device of the present invention promotes proper positioning of the upper arm and particularly the elbow close to the body, which is considered a basic requirement during a golf swing. Additionally, the latter use promotes a correct starting motion of shoulder and chin for takeaway after set-up at the beginning of a swing. As these are initially to an unskilled golfer rather unnatural sequences of movements and positions, the device trains and builds muscle-memory for correct set-up and takeaway, swing, and follow-through.

The device of the present invention is non-specific in its use in regard to a golfer's handedness; i.e. it is usable with equal effectiveness regardless of whether a golfer is right-handed or left-handed, provided the device is worn in the appropriate respective orientation and position.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
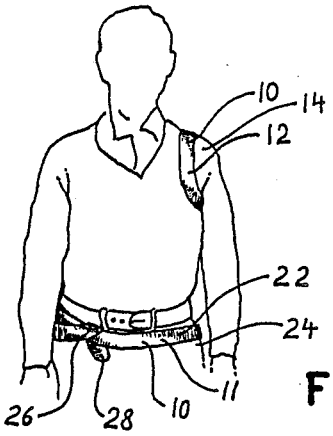
FIG.1 is a schematic front view of a device according to the present invention, shown being worn by a golfer.
Figure 2:
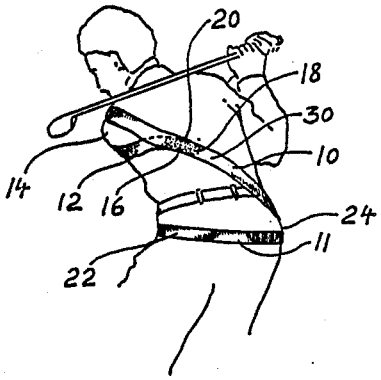
FIG.2 is a schematic rear view of the device of FIG.1, with the golfer positioned at the top of a back stroke.
Figure 4:
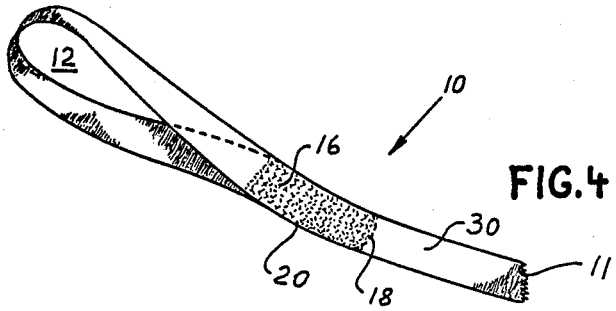
FIG.4 is a schematic fragmental perspective view of a device according to an alternate embodiment of the invention.

Referring to the drawings, in particular to FIGS.1 and 2, a training device for golfers according to principles of the present invention is shown as worn by a golfer. The device comprises a body-engaging member 10 (also as partially shown in FIG. 4) substantially comprised of elastic flat belting 11 and including a loop portion 12 for engaging an arm-shoulder region 14 (of a golfer), a loop fastening means 16 for adjustably and releasably fastening a first end 18 of belt 11 to a belt fastening region 21 to form adjustable loop portion 12, a hip-girding portion 22 substantially encircling a golfer's hip region 24 and preferably crossing the upper buttocks area, a hip securing means 26 for adjustably and releasably securing a second end 28 (of belting 11) to hip-girding portion 22, and a back portion 30 that is disposed substantially diagonally across a golfer's back between arm-shoulder region 14 and hip region 24.

As shown in FIGS.1 and 2, the device or body-engaging member 10 is worn by a right-handed golfer. The identical device is equally suited for use by a left-handed golfer, except that is is then worn on the body in side-reversed manner, having loop portion 12 looping about the right arm-shoulder region and having back portion 30 extend diagonally downwardly across a golfer's back toward his or her left hip.

Flat belting 11 is made from an elastically resilient material, for instance, gum-rubber, latex rubber, or similar elastomer. In an embodiment of the invention, I have found that elastomers in the general hardness range of up to 30 durometer (Shore) and at most 40 durometer are satisfactory when the belt cross-section is about ⅛ by 2 inches. Naturally, different elastically resilient materials in different sizes may be used for flat belting 11, provided that their properties are in accord with the task to be performed. Surface frictional or sticktional properties of flat belting 11 are preferably high, as generally provided by gum-rubber or latex and other elastomers, in order to avoid substantial slippage upon clothing worn by a golfer. Moreover, these properties provide for sticking action (substantially non-slip) between tensioned overlapping portions of flat belting 11 in hip-girding portion 22. Additionally, hip securing means 26 relies to a certain extent on mutual sticktion between portions of belting 11 for securing second end 28 under tension.

Loop portion 12 (see also FIG. 4) is formed by looping back first end 18 and adjustably fastening it by loop fastening means 16 onto back portion 30. As depicted, first end 18 is shown beneath back portion 30. However, it could equally well be fastened over the top, and it need not be in exact mutual alignment, but may cross either over or under back portion 30. As indicated, loop fastening means 16 is a Velcro fastener pair, having each of its members securely attached to the appropriate surface of belting 11, for instance, by being adhesively bonded, welded, sewn on, or secured on other conventional manner. Adjustable loop portion 12 is sized to comfortably slip over the arm into the shown position in arm-shoulder region 14, leaving the remaining length of belting 11 draping down the golfer's back. This remaining belting is thereafter tightly stretched diagonally across the back to beneath the golfer's waist and therefrom around the body in at least one turn about hip region 24 and preferably crossing the upper region of the buttocks. Under continuing tension, second end 28 is wound further, overlapped, and tucked over and under hip girding portion 22, thusly forming hip securing means 26. It will be evident that the location of hip securing means 26 is adjustable to adapt to different body sizes and to provide varying degrees of tension in flat belting 11.

Although the hereinabove described simple hip securing means 26 has proven itself to be very effective, alternate conventional hip securing means may be provided for similar effect in form of adjustable and releasable belt or strap fasteners, such as for example given by Velcro fasteners, multiple snap fasteners, adjustable buckles, etc., as will be further described hereinafter.

It should be recognized that body-engaging member 10 may be also comprised from appropriately joined lengths of differing materials. For example, whereas back portion 30 is preferably of resiliently elastic material (as hereinbefore described) in order to provide the needed tension across the golfer's back, loop portion 12 need not have such resilient and elastic properties. Similarly, hip-girding portion 22 has preferably on its inner surface the described sticktion properties, yet elasticity and resiliency are not as essential to satisfactory function. Thus, for instance, hip-girding portion 22 may comprise an appropriate length of plastic, leather, or webbing material to whose inner surface sticktion pads are attached. Such pads are, for example, conventionally used in tailoring of pants and are attached to the inside of the waist region for purposes of retaining shirts tucked in.

Figure 3:
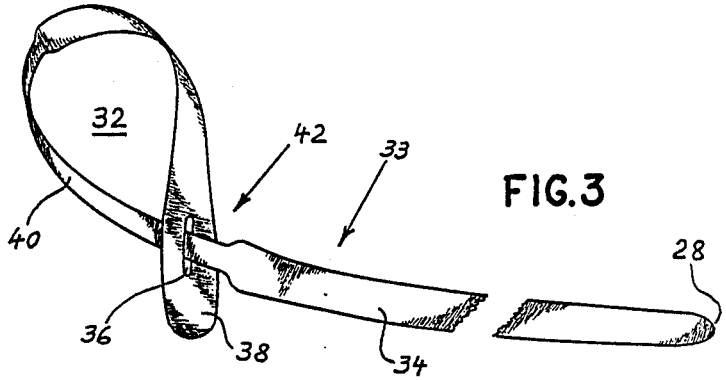
FIG.3 is a schematic fragmented perspective view of a device (apart from the golfer) according to an embodiment of the invention.

Referring now to FIG.3, an alternate body-engaging member 33 comprises a first alternate loop 32, as depicted. First alternate loop 32 is formed from a portion of a belt 34 and it includes an eye 36 in form of a slit-shaped opening through belt 34 near an end 38 thereof and an under-arm portion 40. Loop 32 is formed by threading second end 28 of belt 34 through eye 36. Belt 34 is narrowed down along under-arm portion 40 from its otherwise generally constant width to provide more comfort to the wearer in the under-arm region. The vicinal region about eye 36 (as it is threaded with belt 34) forms an adjustable loop fastening means 42 particularly when appropriately worn in tensioned manner as hereinabove described due to the mutual sticktion properties of the material of belt 34. In all other respects, body-engaging member 33 is substantially identical to the hereinbefore described body-engaging member 10 and is worn and used in the same manner and performs the same function.

Figure 5:
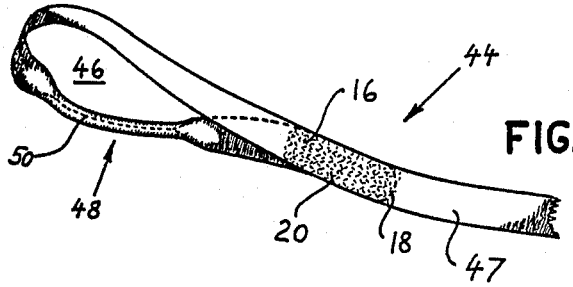
FIG.5 is a schematic fragmental perspective view of a device according to another alternate embodiment of the invention.

Referring now to FIG.5, a body-engaging member 44 comprises a second alternate loop 46 formed by a belt 47, as depicted. Second alternate loop 46 comprises an under-arm portion 48 formed by a length of belt 47 that is bent or rolled about a longitudinal axis and that has its lateral edges 50 fastened together by conventional means, for instance by adhesive or vulcanized bond, sewn seam, staples, etc. Under-arm portion 48 may also be preformed to substantially permanently set in such bent or rolled shape without a need for fastening together of lateral edges 50. Again, the purpose of under-arm portion 48 is to provide greater comfort to the wearer in the under-arm region. In all other respects, body-engaging member 44 is substantially identical to the hereinbefore described body-engaging member 10 and is worn and used in the same manner and performs the same function.

Figure 6:
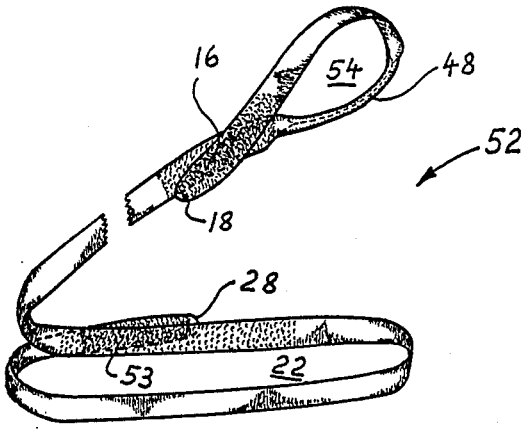
FIG.6 is a schematic fragmented perspective view of a device according to a further embodiment of the invention.

Referring now to FIG.6, a further alternate body-exchanging member 52 is shown that is substantially similar to the body-engaging members 10, 33, and 44 as hereinbefore described in conjunction with FIGS. 1 through 5, except that member 52 employs Velcro-type fastening to adjustably secure second end 28 in overlapping manner, thusly forming hip securing means 53 in hip-girding portion 22. FIG.6 also depicts a third alternate loop 54 that is similar to second alternate loop 46, except that first end 18 is shown looped over (the shoulder) and is adjustably fastened onto the outer surface of body-engaging member 52 by Velcro-type means. Consequently, under-arm portion 48 is disposed in appropriate under-arm location when worn by a golfer as hereinbefore described.

Figure 7:
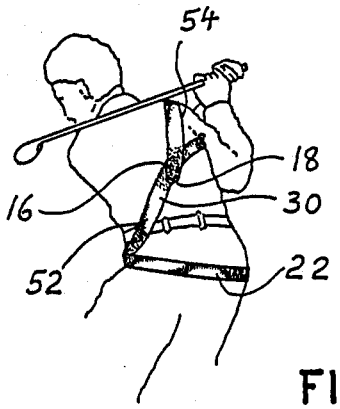
FIG.7 is a schematic rear view of a device according to the present invention, shown being worn in a side-reversed manner by a golfer at the top of a stroke.

FIG.7 shows body-engaging member 52 (also shown in FIG.6) as worn by a golfer. It will be noted that the depiction of FIG. 7 differs fundamentally from the representations in FIGS. 1 and 2 in that body-engaging member 52 is worn by the golfer in side-reversed manner. Nonetheless, it is otherwise worn in exactly the same manner, i.e. engaging an arm in the shoulder region with a hip region approximately diagonally across the golfer's back, and it encircles the hip region below he waist in such a location that it preferably crosses the upper region of the buttocks.

FIGS. 1, 2 and 7 depict use of the training device of the invention by right-handed golfers, whereby respective body-engaging members are worn in corresponding positions. As hereinbefore described, FIGS. 1 and 2 show a particular use of the device for training of proper coordination of the shoulder motion with the leading hip motion. The same device, when worn by a right-handed golfer in side-reversed manner, as depicted in FIG. 7, represents another use, whereby proper positioning of the upper (right) arm and particularly the (right) elbow close to the body during a goal swing is promoted. Additionally, the latter use promotes correct starting movement of the (left) shoulder toward the chin during set-up and takeaway during the preparatory motions at the beginning of a swing. In regard to the latter use, it has been found that the golfer's body reacts to the effect of the device (when worn as shown in FIG. 7 and appropriately tensioned across the back) to keep the right elbow close to the body and to promote movement of the left shoulder toward the chin, as indicated hereinabove and as required for properly executed golf swing motions. Consequently, practise employing the device of the invention as shown in FIG. 7 trains appropriate muscle-memory in proper motions and sequence thereof.

It will be apparent that the training device of the present invention may be employed equally well by left-handed golfers for either of the above described practise uses, provided that it is worn in appropriate orientation and position; i.e. in side reversed manner from the way depicted in FIGS. 1 and 2, or in FIG. 7, respectively. It should be emphasized that the training device of any of the hereinbefore described embodiments is employed without a need for modification or adaptation to its structure for either of the training practise uses hereinbefore described by right-handed or left-handed golfers.

In one use, a training device for golfers according to the present invention, when worn by a golfer as hereinbefore described (particularly in conjunction with FIGS. 1 and 2), promotes proper sequential coordination of the shoulder motion with the leading hip motion during driving and follow-through. This action can be visualized particularly in view of FIG. 2 that depicts a golfer positioned at the top of a back stroke immediately prior to a swing. As hereinbefore described, body-engaging member 10 engages arm-shoulder region 14 with hip region 24 via back portion 30 of body-engaging member 10. Particularly back portion 30 is appropriately stretched to provide pre-tensioning across a golfer's back of an adequate magnitude so that the leading (forward and leftward) motion of the golfer's right hip during a swing will cause a consequent resilient pull along back portion 30 onto arm-shoulder region 14. This pull is not only sensed by the body, but it also resiliently draws arm-shoulder region 14 to automatically follow along with it.

It is well known that this proper motion sequence appears initially highly unnatural to most unskilled golfers and, therefore, provides serious problems in and obstacles to acquisition of correct playing skills. The device of this invention is extraordinarily simple, yet highly effective in automatically promoting and teaching correct coordination of hip, shoulder, and arm motion. In the course of practise, it builds muscle-memory of proper movements and sequence thereof for a correct swing and follow-through without being unduly uncomfortable and constrictive in a golfer's activities. Thusly it significantly speeds up acquisition of golfing skills and reduces chances for bad habits to develop and become ingrained.

In the use of a right-handed golfer depicted in FIG. 7 and particularly described in conjunction therewith, training of the (right) upper arm and the (right) elbow to a close position to the body is promoted. Additionally, especially when back portion 30 is adequately pretensioned, it has been found that during takeaway (after set-up) the golfer is almost automatically reminded (by the perceived tension in back portion 30) to start to move the left shoulder toward the chin whilst keeping the right upper arm close to the right body side. Moreover, it has been found that the body reacts to the tension along back portion 30 during a subsequent swing such as to tend to retain the right elbow close to the body. Both effects of the training device, when it is correctly worn, counteract improper body motions that appear otherwise more natural to an unskilled golfer and thusly promote correct coordination and achieve muscle-memory thereof. Acquisition of useful skills and avoidance of bad habits is, therefore, facilitated by the training device of the present invention.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A training device for golfers comprising a body-engaging member for engaging an arm-shoulder region with a hip region and extending diagonally across a golfer's back, said body-engaging member promoting coordination of the golfer's body and limb motion preparatory to and during a swing, said body-engaging member comprising:

a continuous, elastic belt having a first end and a second end, said belt including:

a loop portion for looping said belt over a shoulder and under the arm in said arm-shoulder region;

a loop-fastening means for fastening said first end to a loop fastening region of said belt to establish said loop portion;

a hip-girding portion for girding said hip region;

a hip securing means for adjustably and releasably securing said second end to said hip-girding portion so that said hip region is securely girded; and, a back portion connecting said loop portion to said hip portion.

2. A training device in accordance with claim 1 wherein said loop fastening means is comprised of synthetic materials which adhere when pressed together.

3. A training device in accordance with claim 1 wherein said loop portion includes an under-arm portion narrower than the width of the remainder of said loop portion.

4. A training device in accordance with claim 3 wherein said under-arm portion is a longitudinally-rolled length of said loop portion.

5. A training device in accordance with claim 3 wherein said under-arm portion is a longitudinally-bent length of said loop portion.

6. A training device in accordance with claim 1 wherein said loop fastening means includes an eye in the form of a through-opening in said belt near said first end, said belt being threaded through said eye to thereby form said loop fastening region.

7. The training device of claim 1 wherein said hip-securing means is formed by said second end overlapping and tucking behind said hip-girded portion.

8. The training device of claim 1 wherein said hip-securing means is comprised of synthetic materials which adhere when pressed together.

9. The training device of claim 8 wherein said loop fastening means is comprised of synthetic materials which adhere when pressed together.

10. The training device of claim 1 wherein said elastic belt is comprised of a single, continuous length of elastomeric material.

11. The training device of claim 10 wherein said elastomeric material is gum rubber.

12. The training device of claim 10 wherein said elastomeric material is latex rubber.

13. The training device of claim 1 wherein at least said back portion of said belt has such fricition and sticktion properties that said belt is substantially free of slippage upon clothing worn by said golfer.

* * * * *